US007878607B2

(12) United States Patent
Huang et al.

(10) Patent No.: US 7,878,607 B2
(45) Date of Patent: Feb. 1, 2011

(54) BALL BEARING SLIDE ASSEMBLY

(75) Inventors: Kuo-Ming Huang, Taipei Hsien (TW); Mo-Ming Yu, Shenzhen (CN); Zong-Yuan Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 503 days.

(21) Appl. No.: 11/952,134

(22) Filed: Dec. 7, 2007

(65) Prior Publication Data

US 2008/0150409 A1 Jun. 26, 2008

(30) Foreign Application Priority Data

Dec. 22, 2006 (CN) ..... 2006 1 0201367

(51) Int. Cl.
*A47B 95/00* (2006.01)

(52) U.S. Cl. ..... 312/334.46

(58) Field of Classification Search ..... 312/333, 312/334.44–334.47, 334.7–334.11, 334.15–334.17, 312/334.25, 334.26, 334.33, 334.36–334.38; 384/18, 21

See application file for complete search history.

(56) References Cited

U.S. PATENT DOCUMENTS

| | | | | |
|---|---|---|---|---|
| 6,254,210 | B1 * | 7/2001 | Parvin | 312/334.46 |
| 6,860,574 | B2 * | 3/2005 | Hwang et al. | 312/334.44 |
| 7,648,214 | B2 * | 1/2010 | Chen et al. | 312/334.47 |
| 2002/0081887 | A1 * | 6/2002 | Judge et al. | 439/348 |
| 2007/0040485 | A1 | 2/2007 | Tseng et al. | |
| 2007/0182294 | A1 * | 8/2007 | Hung | 312/334.46 |

* cited by examiner

*Primary Examiner*—Darnell M Jayne
*Assistant Examiner*—Matthew W Ing
(74) *Attorney, Agent, or Firm*—Frank R. Niranjan

(57) ABSTRACT

A ball bearing slide assembly includes a first slide, a second slide, a slide-aiding member, and a positioning member. The first slide is slidably received in the second slide. The slide-aiding member is slidably received between the first and second slides, and comprises a plurality of ball bearings slidably sandwiched between the first and second slides. The slide-aiding member defines a locking hole. The positioning member is mounted to the second slide and forms a resilient cantilever. A positioning block is formed on the resilient cantilever and engages in the locking hole of the slide-aiding member for temporarily locking the slide-aiding member to the second slide, such that the first slide is slidable inward without pushing the slide-aiding member inward. The first slide deforms the cantilever to disengage the positioning block from the locking hole, such that the slide-aiding member is slidable relative to the first and second slides.

16 Claims, 5 Drawing Sheets

BALL BEARING SLIDE ASSEMBLY

BACKGROUND

1. Field of the Invention

The present invention relates to ball bearing slide assemblies, and particularly to a ball bearing slide assembly having a positioning device for positioning a slide-aiding member thereof.

2. Description of Related Art

A slide assembly is usually used to connect and guide two articles that may be moved relative to each other, such as a cabinet and a server or a cupboard and a drawer. A conventional three-section slide assembly generally includes an outer slide, an intermediate slide, and an inner slide. For example, the outer slide may be fixed in a cabinet, the inner slide may be fixed at a side of the server of the cabinet, and the intermediate slide is received in the outer slide to support the inner slide. The inner slide, the intermediate slide, and the outer slide may be coupled with each other, and the inner slide and the intermediate slide may be moved in the longitudinal axial direction of the outer slide. One or more slide-aiding members, each including ball bearings, may be assembled between two neighboring slides, for facilitating the sliding movement of the slides relative to each other. The slide-aiding member can slide between the neighboring slides. However, the inner slide is difficult to be inserted into an unfixed slide-aiding member because the slide-aiding member may be pushed to slide along the intermediate slide by an end of the inner slide.

What is desired, therefore, is a slide assembly having a positioning device for its slide-aiding member.

SUMMARY

An exemplary ball bearing slide assembly includes a first slide, a second slide, a slide-aiding member, and a positioning member. The first slide is slidably received in the second slide. The slide-aiding member is slidably received between the first and second slides, and comprises a plurality of ball bearings slidably sandwiched between the first and second slides for facilitating the sliding movement of the first slide relative to the second slide. A locking hole is defined in the slide-aiding member. The positioning member is mounted to the second slide and forms a resilient cantilever. A positioning block is formed on the resilient cantilever and engages in the locking hole of the slide-aiding member for temporarily locking the slide-aiding member to the second slide such that the first slide is slidable inward along the slide-aiding member without pushing the slide-aiding member inward. The first slide deforms the cantilever of the positioning member to disengage the positioning block of the cantilever from the locking hole of the slide-aiding member such that the slide-aiding member is slidable relative to the first and second slides.

Other advantages and novel features of the present invention will become more apparent from the following detailed description of an embodiment when taken in conjunction with the accompanying drawings, in which:

DETAILED DESCRIPTION

Figure 1:
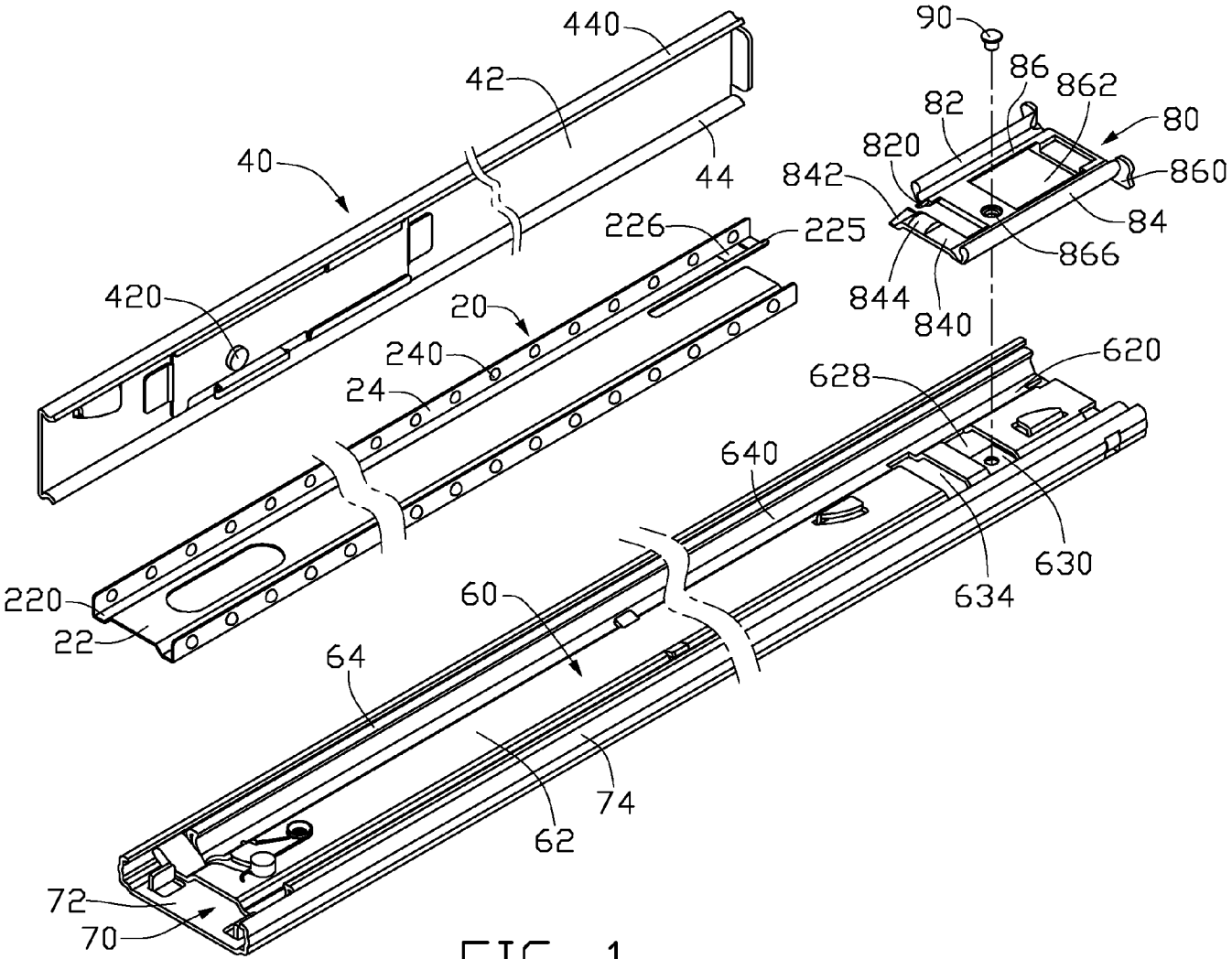
FIG. 1 is a partially exploded, isometric view of a ball bearing slide assembly according to an embodiment, the ball bearing slide assembly including a slide-aiding member, a first slide, a second slide, a third slide, and a positioning member.

Referring to FIG. 1, in an embodiment, a ball bearing slide assembly includes a slide-aiding member 20, a first slide 40, a second slide 60 receiving the first slide 40, a third slide 70 receiving the second slide 60, and a positioning member 80 for positioning the slide-aiding member 20 relative to the second slide 60.

Figure 2:
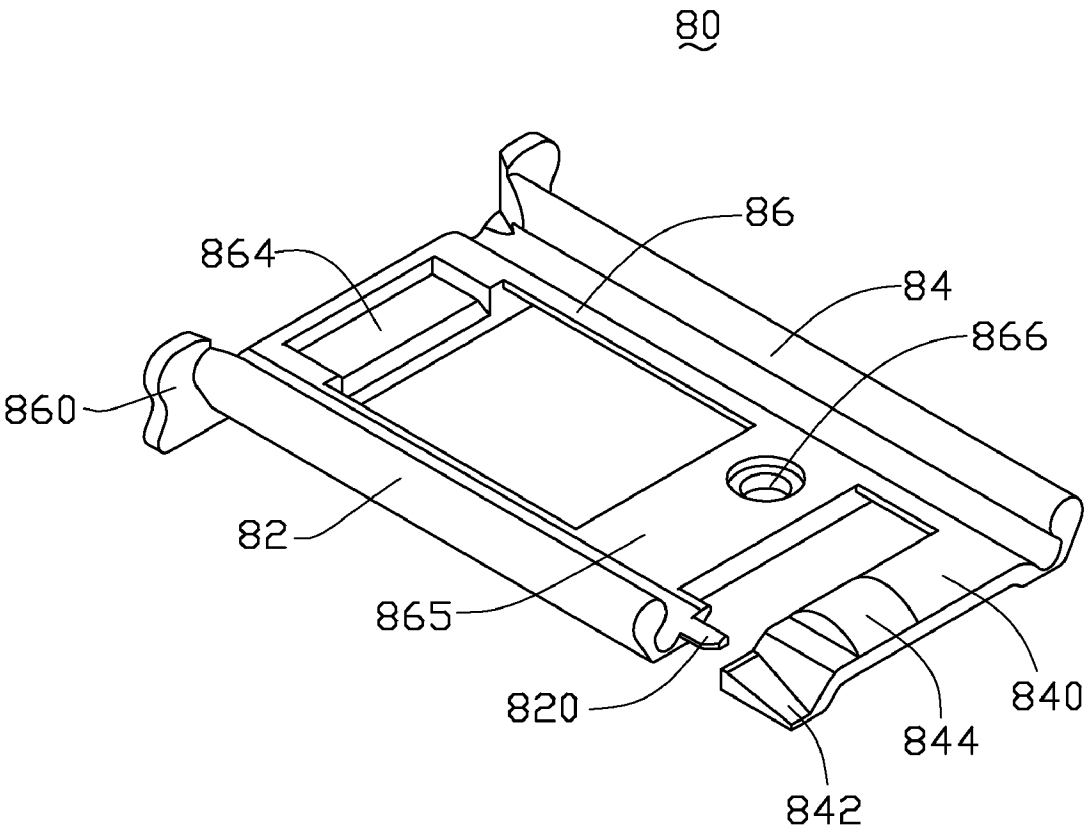
FIG. 2 is an enlarged view of the positioning member of FIG. 1, but viewed from another aspect.

Referring also to FIG. 2, the positioning member 80 includes a plate portion 86 and two elongated limbs 82, 84 respectively bent from two sides of the plate portion 81 in the same direction. The elongated limb 84 of the positioning member 80 is longer than the elongated limb 82 thereof. A stopping flange 860 is perpendicularly bent out from an end of the positioning member 80. A rectangular opening 862 is defined through the plate portion 86 of the positioning member 80. A recess 864 is defined in the plate portion 86 of the positioning member 80 adjacent the end of the positioning member 80. The recess 864 communicates with the opening 862. A coupling bridge 865 is formed at the other end of the positioning member 80 between the two elongated limbs 82, 84. A fixing hole 866 is defined through the coupling bridge 865. A pressing tab 820 extends from a free end of the elongated limb 82 of the positioning member 80, away from the stopping flange 860 of the positioning member 80. A bottom surface of a distal end of the pressing tab 820 is generally arcuate. A resilient cantilever 840 extends generally perpendicularly from an end portion of the elongated limb 84 of the positioning member 80, towards the elongated limb 82. A free end of the resilient cantilever 840 extends slantingly downward. A wedged positioning block 842 is formed at the free end of the resilient cantilever 840. A wedged surface of the positioning block 842 is opposite to the arcuate bottom surface of the pressing tab 820. A curved protrusion 844 is formed on the resilient cantilever 840, offset relative to the positioning block 842 along a direction substantially perpendicularly to the lengthwise direction of the slide-aiding member 20.

The slide-aiding member 20 is sandwiched between the first slide 40 and the second slide 60. The slide-aiding member 20 has a substantially U-shaped cross-section, and includes a longitudinal web 22, and two longitudinal arms 24 respectively perpendicularly bent from two lateral edges of the web 22 in the same direction. The web 22 is depressed to form two longitudinal troughs 220 adjacent the two arms 24. A locking portion 225 including one trough 220 of the web 22, extends partially from an end of the slide-aiding member 20 along the longitudinal direction of the slide-aiding member 20. A locking hole 226 is defined in the locking portion 225 and the trough 220 of the web 22. The positioning block 842 of the positioning member 80 is correspondingly received in the locking hole 226 of the locking portion 225. A plurality of aligned installing holes is defined in each arm 24. A plurality of ball bearings 240 is respectively received in the installing holes of the two arms 24 of the slide-aiding member 20, for facilitating the sliding movement of the first slide 40 relative to the second slide 60.

The first slide 40 has a substantially U-shaped cross-section, and includes a longitudinal web 42, and two longitudinal arms 44 respectively perpendicularly bent from two lateral edges of the web 42 in the same direction. A release post 420 protrudes from the web 42 adjacent an end thereof. Each arm 44 is depressed towards the opposite arm 44 to form a sliding channel 440 in an outer surface thereof, allowing the ball bearings 240 of the slide-aiding member 20 to slide therein.

Figure 3:
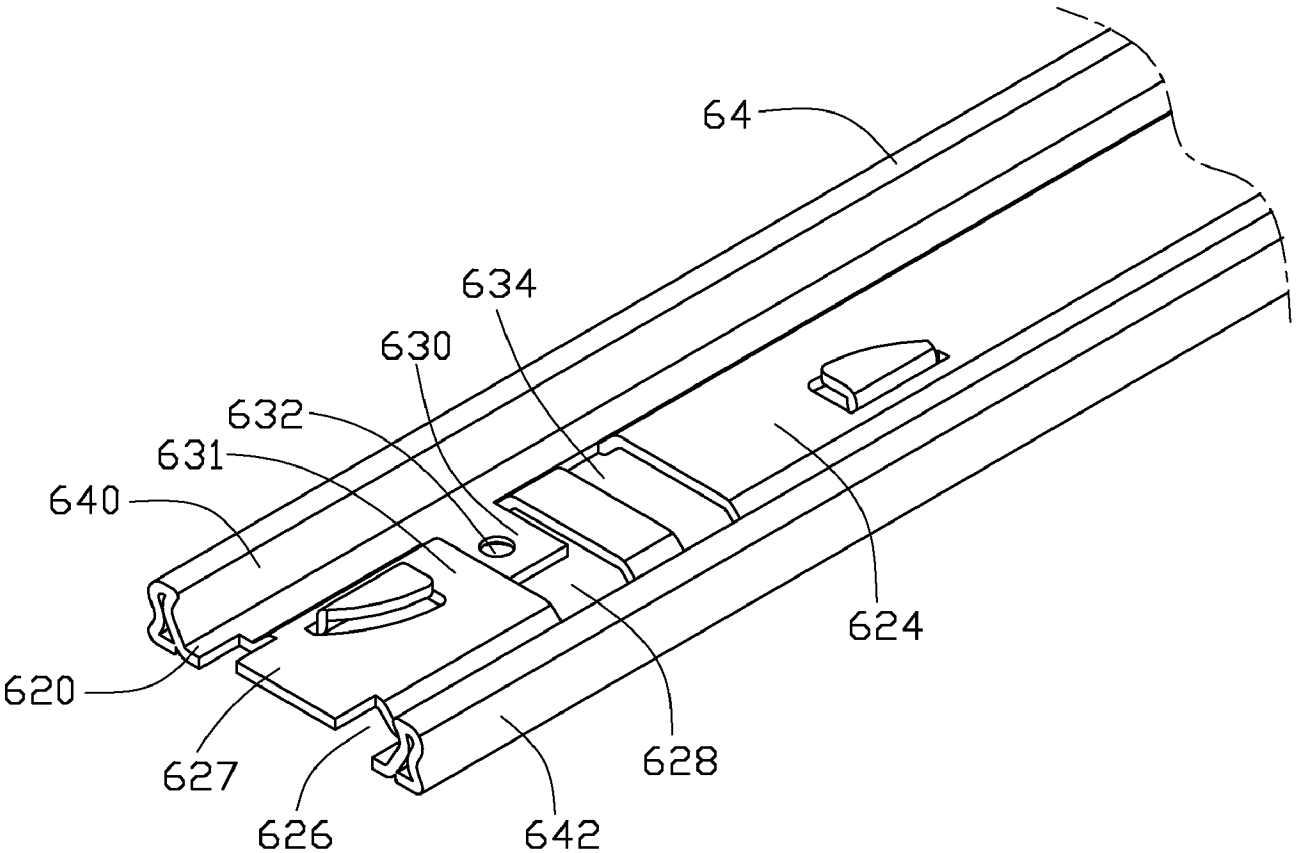
FIG. 3 is an enlarged view of an end section of the second slide of FIG. 1.

Referring also to FIG. 3, the second slide 60 has a substantially U-shaped cross-section, and includes a longitudinal web 62, and two longitudinal arms 64 respectively perpendicularly bent from two lateral edges of the web 62 in the same direction. The web 62 and the arms 64 cooperatively define a receiving space for receiving the slide-aiding member 20 and the first slide 40. The web 62 is depressed outward to form two longitudinal troughs 620 adjacent the two arms 64. Two notches 626 are respectively defined at two junctions of the two troughs 620 and the web 62 at an end of the web 62, thereby forming a maintaining tab 627 between the two notches 626. The maintaining tab 627 is received in the recess 864 of the positioning member 80. The web 62 is stamped to form a mounting portion 630 adjacent the end thereof, leaving a receiving groove 628 therein. An aligning portion 631 is formed on the web 62 between the receiving groove 628 and the maintaining tab 627, corresponding the opening 862 of the positioning member 80. A mounting hole 632 is defined through the mounting portion 630. A passage 634 is defined through the web 62 between the two troughs 620 thereof, for receiving the resilient cantilever 840 of the positioning member 80. The passage 634 is spaced at some distance from the receiving groove 628 of the web 62. Each arm 64 defines an inner channel 640 in an inner surface thereof, and an outer channel 642 in an outer surface thereof.

The third slide 70 has a substantially U-shaped cross-section, and includes a longitudinal web 72, and two longitudinal arms 74 respectively perpendicularly bent from two lateral edges of the web 72 in the same direction. Each arm 74 defines an inner channel in an inner surface thereof. The second slide 60 is slidably received in the third slide 70 by some slide-aiding structure mounted between the inner channels of the two arms 74 of the third slide 70 and the corresponding outer channels 642 of the two arms 64 of the second slide 60, for facilitating the sliding movement of the second slide 60 relative to the third slide 70.

Figure 4:
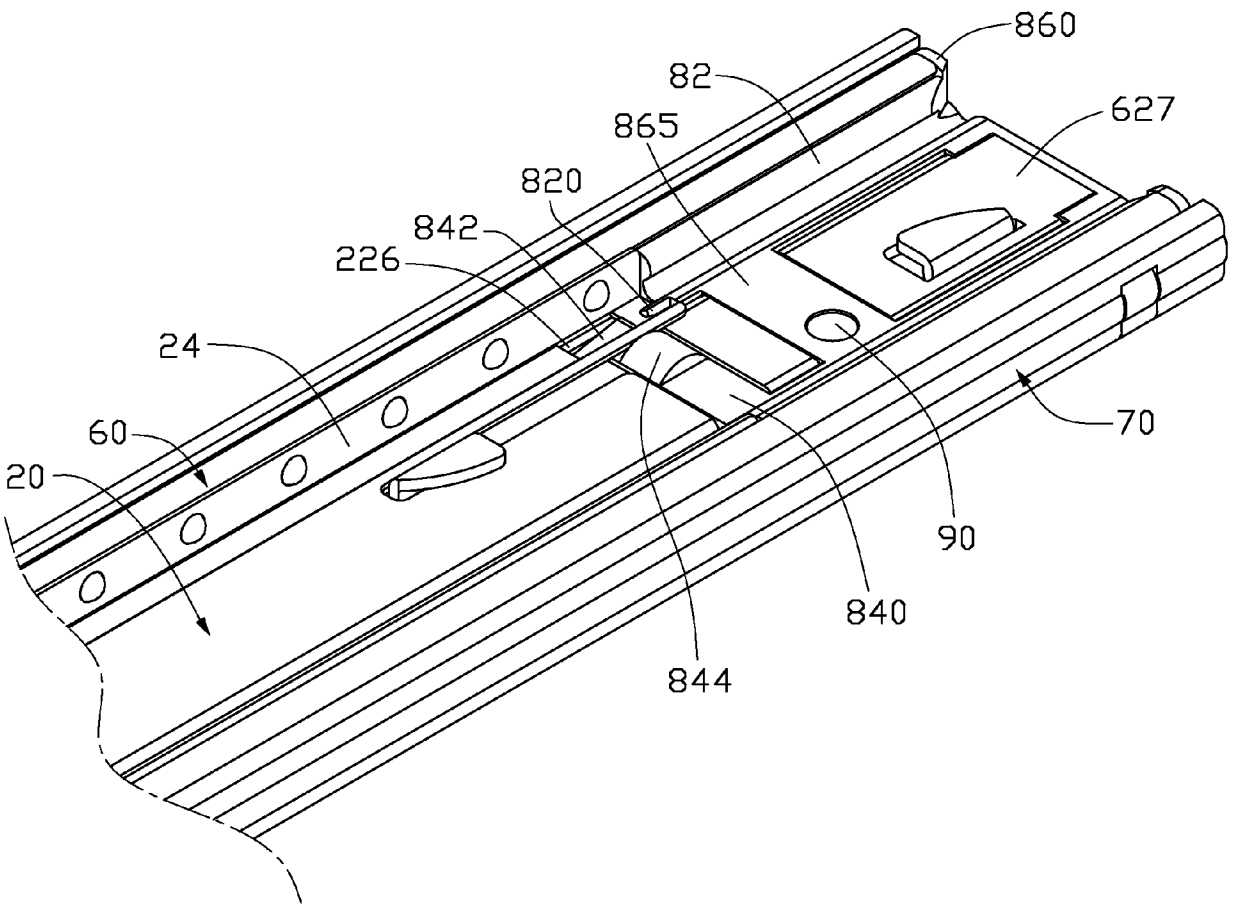
FIG. 4 is a partially assembled view of FIG. 1, with the first slide being unattached and the slide-aiding member at a locked position.

Referring also to FIG. 4, in assembly, a rear end of the slide-aiding member 20 is inserted into a front end of the second slide 60, between the two arms 64 of the second slide 60. The front end of the slide-aiding member 20 is pushed rearward, the slide-aiding member 20 is received in and slides forward along the second slide 60. The ball bearings 240 of the slide-aiding member 20 are received in and slide along the inner channels 640 of the arms 64 of the second slide 60.

The maintaining tab 627 of the second slide 60 is received in the opening 862 of the positioning member 80. The positioning member 80 is pushed relative to the slide-aiding member 20, and the other end of the positioning member 80, having the resilient cantilever 840, is simultaneously pressed downward. The elongated limbs 82, 84 of the positioning member 80 respectively urge the corresponding arms 64 of the second slide 60, and are snappingly received in the corresponding inner channels 640 of the two arms 64. The maintaining tab 627 of the second slide 60 is received in the recess 864 of the positioning member 80, and the stopping flange 860 abuts on the end edge of the second slide 60. Thus the aligning portion 631 of the second slide 60, and the coupling bridge 865 and the resilient cantilever 840 of the positioning member 80 are respectively held in the opening 862 of the positioning member 80, and the receiving groove 628 and the passage 634 of the second slide 60. The fixing hole 866 of the coupling bridge 865 aligns with the mounting hole 632 of the mounting portion 630. A rivet 90 extends through the fixing hole 866 of the coupling bridge 865, and is inserted into the mounting hole 632 of the second slide 60, the positioning member 80 is then mounted to the second slide 60 by the rivet 90.

The slide-aiding member 20 is slidably pushed toward the positioning member 80, and the positioning block 842 of the resilient cantilever 840 of the positioning member 80 is pressed downward by the distal end of the locking portion 225 of the slide-aiding member 20. The resilient cantilever 840 is elastically deformed. The distal end of the locking portion 225 clears the positioning block 842 and enters a gap between the pressing tab 820 of the positioning member 80 and the positioning block 842. The arcuate bottom surface of the pressing tab 820 facilitates the entering of the distal end of the locking portion 225 in the gap. When the locking hole 226 of the locking portion 225 aligns with the positioning block 842, the deformed resilient cantilever 840 is restored and the positioning block 842 is locked in the locking hole 226, such that the slide-aiding member 20 is locked on the second slide 60 by the positioning member 80 and cannot be pulled back along the second slide 60. During the entering of the distal end of the locking portion 225 into the gap, the distal end of the locking portion 225 is pressed downward by the pressing tab 820 of the positioning member 80 to abut against the corresponding trough 620 of the second slide 60, thereby preventing the distal end of the locking portion 225 from tilting upward. That prevents damage to the slide-aiding member 20 during the entering of the first slide 40 into the slide-aiding member 20.

Figure 5:
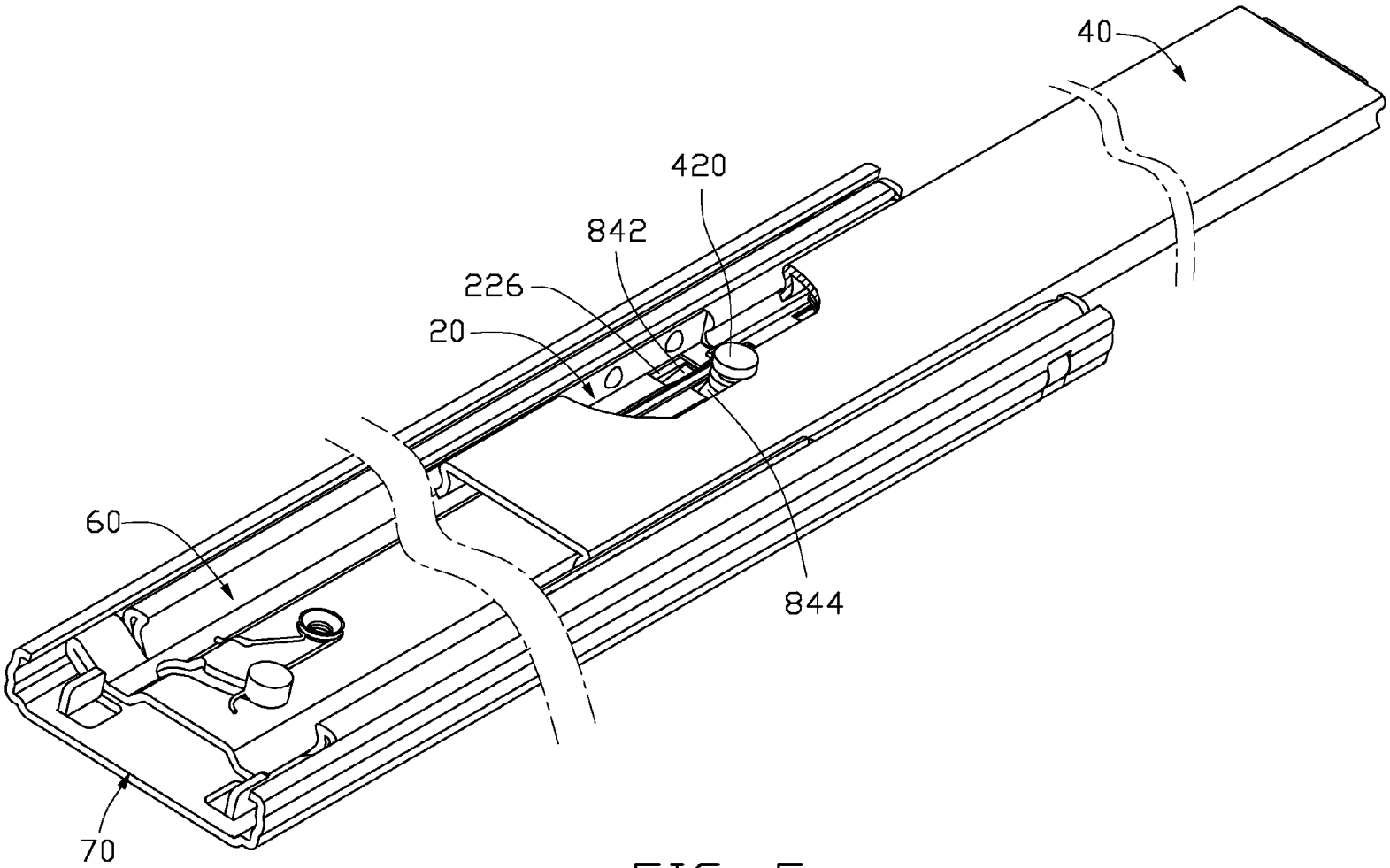
FIG. 5 is an assembled view of FIG. 1, showing the slide-aiding member at an unlocked position.

Referring also to FIG. 5, a front end of the first slide 40 is inserted into the positioning member 80, between the two limbs 82, 84 of the positioning member 80. The first slide 40 is pushed forward along the positioning member 80. When the first slide 40 enters into the slide-aiding member 20, the sliding channels 440 of the arms 44 of the first slide 40 contact the ball bearings 240 of the slide-aiding member 20 to facilitate the movement of the first slide 40. In the forward movement of the first slide 40 along the second slide 60, the release post 420 of the first slide 40 abuts against the curved protrusion 844 of the resilient cantilever 840 of the positioning member 80, and the resilient cantilever 840 is deformed toward the third slide 70. The positioning block 842 of the cantilever 840 is disengaged from the locking hole 226 of the locking portion 225 of the slide-aiding member 20. Thus the slide-aiding member 20 is unlocked, and can slide forward along the second slide 60, together with the first slide 40. When the locking portion 225 of the slide-aiding member 20 departs from the positioning block 842 of the resilient cantilever 840, the resilient cantilever 840 is restored.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ball bearing slide assembly comprising:

a first slide, the first slide forming a release portion;

a second slide slidably receiving the first slide;

a slide-aiding member slidably received between the first and second slides, and comprising a plurality of ball bearings slidably sandwiched between the first and second slides for facilitating the sliding movement of the first slide relative to the second slide, a locking portion extending from an end of the slide-aiding member and defining a locking hole; and a positioning member mounted to the second slide and forming a resilient cantilever, a positioning block being formed on the resilient cantilever and engaging in the locking hole of the slide-aiding member for temporarily locking the slide-aiding member to the second slide such that the first slide is slidable inward along the slide-aiding member without pushing the slide-aiding member inward, the cantilever forming a protrusion, when the first slide is further slid inward, the release portion of the first slide urging the protrusion of the cantilever to deform the cantilever of the positioning member to disengage the positioning block of the cantilever from the locking hole of the slide-aiding member such that the slide-aiding member is slidable relative to the first and second slides;

wherein the locking portion is adjacent to the positioning member, a pressing tab extends from the positioning member, adjacent to the positioning block of the cantilever, and a distal end of the locking portion is inserted in a gap between the pressing tab and the positioning block of the cantilever and pressed by the pressing tab.

2. The ball bearing slide assembly as described in claim 1, wherein a passage is defined in the second slide for receiving the resilient cantilever of the positioning member.

3. The ball bearing slide assembly as described in claim 1, wherein a fixing hole is defined in the positioning member, a mounting hole is defined in the second slide corresponding to the fixing hole of the positioning member, and a rivet is inserted in the fixing hole of the positioning member and the mounting hole of the second slide to secure the positioning member to the second slide.

4. The ball bearing slide assembly as described in claim 1, wherein the positioning member comprises a plate portion, an opening is defined through the plate portion of the positioning member, a recess is defined in the plate portion of the positioning member communicating with the opening of the plate portion, the second slide comprises a longitudinal web, the web of the second slide is depressed to form two spaced troughs, two notches are respectively defined at two junctions of the two troughs and the web at an end of the web, forming a maintaining tab between the two notches, and the maintaining tab is held in the recess of the positioning member through the opening thereof.

5. The ball bearing slide assembly as described in claim 4, wherein a coupling bridge is formed on the plate portion of the positioning member, away from the recess thereof, and a mounting portion is formed on the web of the second slide, leaving a receiving groove in the web of the second slide for receiving the coupling bridge.

6. The ball bearing slide assembly as described in claim 4, wherein the second slide further comprises two longitudinal arms respectively bent from two lateral edges of the web thereof in the same direction, an inner channel is defined in each of the arms of the second slide, and the positioning member comprises two elongated limbs bent from two sides thereof in the same direction, for being received in the corresponding inner channels of the second slide.

7. The ball bearing slide assembly as described in claim 4, wherein a stopping flange is bent out from an end of the positioning member, adjacent the recess of the positioning member, and the stopping flange abuts against an outer edge of the end of the second slide, having the two notches.

8. A slide assembly comprising:

a first slide comprising a longitudinal web and two longitudinal arms respectively bent from two lateral edges of the web, a release portion protruding from the web;

a second slide receiving the first slide which is movable relative to the second slide in a back-and-forth direction, the second slide comprising a longitudinal web and two longitudinal arms respectively bent from two lateral edges of the web;

a slide-aiding member sandwiched between the first slide and the second slide, and comprising a longitudinal web and two longitudinal arms respectively bent from two lateral edges of the web, a locking portion extending from an end of the web of the slide-aiding member, a locking hole being defined in the locking portion of the web of the slide-aiding member; and a positioning member mounted to the second slide and forming a resilient cantilever, a positioning block being formed on the resilient cantilever and engaging in the locking hole of the slide-aiding member for temporarily securing the slide-aiding member to the second slide in a first position such that the first slide is slidable inward along the slide-aiding member without pushing the slide-aiding member inward, the cantilever forming a protrusion, when the first slide is further slid inward, the cantilever of the positioning member being driven by the release portion of the first slide pressing the protrusion, whereby the positioning block disengages from the locking hole to release the slide-aiding member from the second slide in a second position;

wherein the protrusion is offset relative to the positioning block along a direction substantially perpendicular to a lengthwise direction of the slide-aiding member.

9. The slide assembly as described in claim 8, wherein a plurality of installing holes is defined in the arms of the slide-aiding member, and a plurality of ball bearings is received in the installing holes to slidably contact with the arms of the first and second slides, for facilitating the sliding movement of the first slide relative to the second slide.

10. The slide assembly as described in claim 9, wherein each of the arms of the first slide forms a sliding channel in an outer surface thereof, each of the arms of the second slide forms an inner channel in an inner surface thereof, and the ball bearings of the slide-aiding member are received in and slidable along the sliding channels and the inner channels.

11. The slide assembly as described in claim 8, wherein a locking portion extends from an end of the slide-aiding member, adjacent the positioning member, the locking hole is defined in the locking portion, a pressing tab extends from the positioning member, adjacent the positioning block of the cantilever, and a distal end of the locking portion is inserted in a gap between the pressing tab and the positioning block of the cantilever and pressed by the pressing tab.

12. The slide assembly as described in claim 8, wherein a fixing hole is defined in the positioning member, a mounting hole is defined in the second slide corresponding to the fixing hole of the positioning member, and a rivet is inserted in the fixing hole of the positioning member and the mounting hole of the second slide to secure the positioning member to the second slide.

13. The slide assembly as described in claim 8, wherein the positioning member comprises a plate portion, an opening is defined through the plate portion of the positioning member, a recess is defined in the plate portion of the positioning member communicating with the opening of the plate portion, the web of the second slide is depressed outward to form two spaced troughs, two notches are respectively defined at two junctions of the two troughs and the web of the second slide at an end of the second slide, forming a maintaining tab between the two notches, and the maintaining tab is held in the recess of the positioning member through the opening thereof.

14. The slide assembly as described in claim 13, wherein a coupling bridge is formed on the plate portion of the positioning member, away from the recess thereof, and a mounting portion is formed on the web of the second slide, leaving a receiving groove in the web of the second slide for receiving the coupling bridge.

15. The slide assembly as described in claim 13, wherein an inner channel is defined in each of the arms of the second slide, and the positioning member comprises two elongated limbs bent from two sides of the plate portion, for being received in the corresponding inner channels of the second slide.

16. The slide assembly as described in claim 13, wherein a stopping flange is bent out from an end of the positioning member, adjacent the recess of the positioning member, and the stopping flange abuts against an outer edge of the end of the second slide, having the two notches.

* * * * *